US008172083B2

(12) United States Patent
Mahalingam

(10) Patent No.: US 8,172,083 B2
(45) Date of Patent: May 8, 2012

(54) SYSTEMS FOR STORING BEVERAGE CONTAINERS DURING TRANSPORT SHIPPING AND WAREHOUSING

(76) Inventor: Padmanabhan Mahalingam, Madras (IN)

( * ) Notice: Subject to any disclaimer, the term of this patent is extended or adjusted under 35 U.S.C. 154(b) by 0 days.

(21) Appl. No.: 12/830,870

(22) Filed: Jul. 6, 2010

(65) Prior Publication Data

US 2010/0270196 A1 Oct. 28, 2010

Related U.S. Application Data

(62) Division of application No. 12/061,037, filed on Apr. 2, 2008, now abandoned.

(60) Provisional application No. 60/913,137, filed on Apr. 20, 2007.

(51) Int. Cl.
*B65D 85/00* (2006.01)
*B65D 81/02* (2006.01)
*A47B 73/00* (2006.01)

(52) U.S. Cl. ..... 206/429; 206/433; 211/74; 217/21; 217/26.5

(58) Field of Classification Search ..... 206/427–429, 206/433, 499, 504, 519, 562–564; 211/73–74; 217/19, 21, 26.5
See application file for complete search history.

(56) References Cited

U.S. PATENT DOCUMENTS

| | | | | |
|---|---|---|---|---|
| 204,259 | A * | 5/1878 | Strauss | 217/21 |
| 1,908,389 | A * | 5/1933 | White | 217/26.5 |
| 1,967,037 | A * | 7/1934 | Mann | 217/21 |
| 2,593,430 | A * | 4/1952 | Frankenstein | 206/446 |
| 3,612,336 | A * | 10/1971 | Wilkich | 206/162 |
| 3,807,573 | A * | 4/1974 | Prosdocimo et al. | 211/74 |
| 4,515,334 | A * | 5/1985 | Horne | 211/74 |
| 5,219,072 | A * | 6/1993 | Sauer | 217/19 |
| 5,335,770 | A * | 8/1994 | Baker et al. | 206/433 |
| 2004/0089621 | A1* | 5/2004 | Gangloff | 211/74 |
| 2008/0197037 | A1* | 8/2008 | O'Brien et al. | 206/429 |

* cited by examiner

*Primary Examiner* — Bryon Gehman
(74) *Attorney, Agent, or Firm* — Donald R. Boys; Central Coast Patent Agency, Inc.

(57) ABSTRACT

An apparatus for supporting liquid-filled containers having removable closures contacting an interface at one end, in a manner to attenuate escape of gas from the containers between the closures and the interface has a supporting framework and at least one insert within the framework, the insert engaging the framework and presenting a surface having a plurality of indentions in the shape of the liquid-filled containers, each indention conforming to shape of one of the containers in a manner that a container placed in the indention is supported with an axis of symmetry of the container at an acute angle with horizontal and with closure end down, such that liquid in the container surrounds the closure and interface, so gas will not escape between the closure and the interface.

4 Claims, 5 Drawing Sheets

SYSTEMS FOR STORING BEVERAGE CONTAINERS DURING TRANSPORT SHIPPING AND WAREHOUSING

CROSS-REFERENCE TO RELATED APPLICATIONS

The present invention is a divisional of and claims priority to application Ser. No. 12/061,037 filed on Apr. 2, 2008 now abandoned, which claims priority to a U.S. provisional patent application Ser. No. 60/913,137, filed Apr. 20, 2007, entitled "Crate for Storing Beverage Containers During Transport, Shipping, and Warehousing"; disclosures of which are incorporated in their entirety at least by reference.

BACKGROUND OF THE INVENTION

1. Field of the Invention

The present invention is in the field of shipping and storage crates or containers and pertains particularly to a crate for storing or shipping aerated or carbonated liquids contained in bottles or cans.

2. Discussion of the State of the Art

Aerated beverages such as soda pop, sparkling water, and champagne with crown cork closures may lose their 'fizz' or aeration during transportation and storage. The problem is more pronounced in countries where one or combinations of the following conditions exist. For example, the climate is hot or the transportation is not smooth or the beverages travel a long distance to reach the marketplace. Moreover, beverages may also lose aeration and become 'flat' when stored at home for longer periods especially when the climate is hot.

In current art, crates used to transport and store aerated beverages maintain the individual beverage containers in an upright position within the crate. Therefore, gas tends to collect in the air space between the liquid and the opening feature of the container, be that of a cork, bottle cap, or pull tab of a can, for example. Because compressed air or gas can escape up through a cap, cork or pull tab easier than it may escape down through the liquid in a container, it has occurred to the inventor that what is needed in the art is a crate for storing or shipping beverage containers that retains the containers in an inverted position with the container opening below the level of liquid in the container.

SUMMARY OF THE INVENTION

A problem stated above is that existing shipping crates or containers, including point of sale cartons containing beverage containers position the containers upright potentially allowing gasses to escape from the individual containers under certain conditions such as warm and humid weather and long bumpy transportation routes used during some shipments.

The inventor considered the functional elements of beverage shipping crates and containers looking for elements that could be modified to promote less leakage of gasses from individual containers under the conditions mentioned. The success of every shipment of aerated beverages depends in part on the condition of each individual beverage and shelf life of the beverage stability over time during storage. Flat beverages are a byproduct of the adverse shipping conditions mentioned above which currently cannot be avoided in all instances.

In an inventive moment, the inventor concluded that if a shipping container were created that would position the beverage containers according to certain criterion, the openings of those containers could be held below the air pockets in each of the individual beverage containers in the shipping container. Therefore, the inventor has provided a beverage shipping crate that can be manually or machine packed that allowed the beverage containers contained therein to be positioned for shipment such that the propensity for gases leaking out of the containers through the container openings was dramatically reduced or eliminated entirely.

Accordingly an apparatus for supporting liquid-filled containers having removable closures contacting an interface at one end, in a manner to attenuate escape of gas from the containers between the closures and the interface is provided, comprising a supporting framework, and at least one insert within the framework, the insert engaging the framework and presenting a surface having a plurality of indentions in the shape of the liquid-filled containers, each indention conforming to shape of one of the containers in a manner that a container placed in the indention is supported with an axis of symmetry of the container at an acute angle with horizontal and with closure end down, such that liquid in the container surrounds the closure and interface, so gas will not escape between the closure and the interface.

IN one embodiment there are two or more inserts positioned in the apparatus, supporting liquid-filled containers in indentions in each of the inserts. Also in one embodiment the at least one insert is implemented from a sheet of plastic material by heat-molding over a form. There may further be divider panels between layers of supported liquid-filled containers. In one embodiment the inserts are implemented in Styrofoam material.

BRIEF DESCRIPTION OF THE DRAWING FIGURES

DETAILED DESCRIPTION

The inventor provides a method and apparatus for storing and transporting beverage containers of carbonated or aerated liquids, the method meant to reduce or eliminate chance of gasses escaping the individual containers, including leakage under adverse conditions, such as long bumpy transportation routes, hot humid weather, and long storage periods resulting in loss of evanescence or "fizz".

Figure 1:
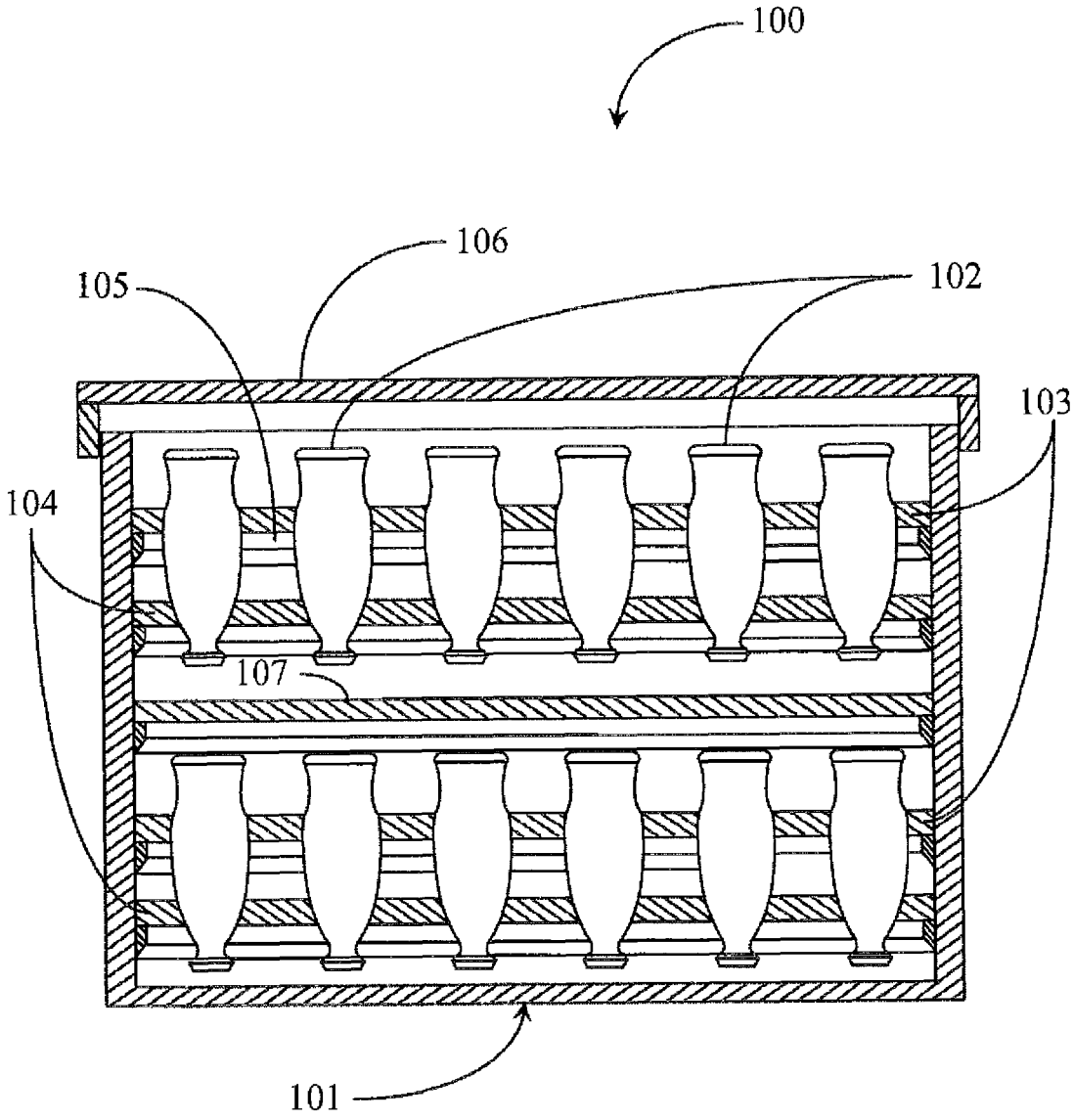
FIG. 1 is a cross-section of a shipping crate for beverage containers according to an embodiment of the present invention.

FIG. 1 is a cross-section of a shipping crate 100 for beverage containers according to an embodiment of the present invention. Referring now to FIG. 1, a loaded shipping crate 100, illustrated in cross-section, is provided for retaining individual beverage containers 102 for transportation and storage. Crate 100 may be manufactured of a durable material 101 like plastic, wood, or some other durable, but preferably lightweight material. Crate 100 is rectangular in this example, having four sides or vertical walls and a bottom. In other embodiments, other geometric profiles may be used in the manufacture of crate 100 such as circular, for example.

In one embodiment crate 100 has a lid or top 106 used to secure the contents (beverage containers) of crate 100 while in transportation. Top 106 is not absolutely required in order to practice the present invention. In this example, crate 100 has a plurality of removable plates 103 and 104 inserted onto a like number of shelves 105 fixed into position within crate 100. Top plates 103 and bottom plates 104 are provided as rectangular staging plates in this example, and are dimensionally slightly smaller that the inside rectangular dimension of crate 100 to facilitate easy placement within and removal from the enclosure. Plates 103 and 104 are of a thickness suitable to promote resilience and to prevent sagging or bowing under the weight of contents retained.

Shelves 105 may extend completely around the inside walls of crate 100 providing a reliable base for a top or bottom plate to rest on, or may be implemented just on opposite sides of crate 100. Shelves 105 may be contiguously formed to the walls of crate 100 during manufacture or molding. In one embodiment, shelves 105 may be of shorter lengths attached or affixed to opposing walls of crate 100 in sufficient numbers to produce the required horizontal base support to accept the rectangular plates. In this embodiment, the plates are held within the enclosure on the shelves horizontally and spaced apart vertically.

In this embodiment, crate 100 has beverage containers 102, in this case capped bottles, retained therein inverted from the usual upright position in which bottles are generally transported, such the caps are at the lowermost position of the bottles in the crate. Top plate 103 has a pattern of through-openings or cutouts for the purpose of arranging beverage containers 102 in a substantially symmetrical pattern such as in two or more rows. Top plates 103 are aligned vertically above and substantially coplanar to bottom plates 104. Plates 103 and 104 are spaced apart generally according to the length and shape of any beverage container (bottle) 102, that crate 100 may be adapted to retain. Bottom plates 104 have a like number of openings or cutouts as top plates 103, arranged in substantially the same symmetrical pattern. So the openings in top plate 103 are in substantial vertical alignment with the openings in bottom plate 104.

The openings in bottom plates 104 are adapted to nestle and support each bottle 102, in this particular case, by the neck portion of the bottle. The diameters of the openings or cutouts in bottom plates 104 are smaller than the overall diameter of the beverage containers. The openings in top plate 103 are adapted to support the major diameter of bottle 102 and to generally support the bottles in a substantially vertical position for transportation. The openings or cutouts in top plates 103 are somewhat larger than the major outside diameter of the beverage containers, in this case bottles. The exact diameters of the cutouts for both plates 104 and 103 are a matter of design and generally conform to the shape of the containers that the plates will stage within the enclosure. Plates 103 and 104 together form a rack system for suspending bottles 102 within crate 100 in an upside-down orientation.

In this example, there are two levels of suspended bottles 102 within crate 100. There may be just one level or more than two levels of bottles within crate 100 without departing from the spirit and scope of the invention. Likewise, each level may comprise any number of bottles depending on the size of the crate. There is no strict limitation regarding the number of bottles 102 that can be loaded into crate 100 except for the design of the crate.

Crate 100 has a level divider plate 107 inserted onto a shelf 105 in this example. Divider plate 107 may be identical to plates 103 in material makeup and in overall dimensioning. Plate 107 does not require any openings as it is used to close off one level of bottles from an adjacent level. There may be more than two levels of bottles retained within crate 100; therefore there may be more than one divider plate 107 for separating the levels. Divider plates 107 may have upward protrusions or arms generally aligned with the openings of lower or bottom plate 103 in a case where beverage containers stored in the enclosure have a uniform major diameter such as aluminum cans. The cans then are held in position in the openings of a lower and upper plate by the protrusions on the divider plate and the openings in both plates are of the same diameter, just larger than the major diameter of the can.

In one embodiment of the present invention, plates 103 and 104 are adapted to be hung into position by hooks instead of being placed on fixed shelves. In another embodiment, the height placement of shelves 105 within crate 100 is adjustable. For example, in one embodiment multiple installation points are provided at different heights within crate 100. In another embodiment, vertical tracks are installed one each on the inside walls of crate 100 allowing custom adjustment of height dimensioning of plates 103 and 104 and hence their respective spacing between them in a rack.

Bottles 102 in the embodiment shown are supported by the neck within crate 100 using bottom plate 104, such that the caps of those bottles do not have contact with the bottom of crate 100 or with a crate level-dividing plate 107. Further support of bottles 102 is achieved by plate 103. A user may remove any bottle 102 from an accessible level of crate 100 without removing any plates, except perhaps the dividing plates separating levels. The bottles may be removed simply by grasping the bottle at its base and pulling it vertically upward and out of crate 100. Dividing plate 107 usually must be removed from crate 100 before an underlying level of bottles may be accessed. In a preferred embodiment, crate 100 is loaded with bottles from the bottom layer up and may be divested of bottles from the top layer down.

In the embodiment shown in FIG. 1 the invention supports the bottles in such a fashion that liquid is in contact with the caps at an interface between the cap and its bottle. An additional sealing opportunity exists because of the higher viscosity of liquid preventing aeration or gasses from escaping from a bottle.

Figure 2:
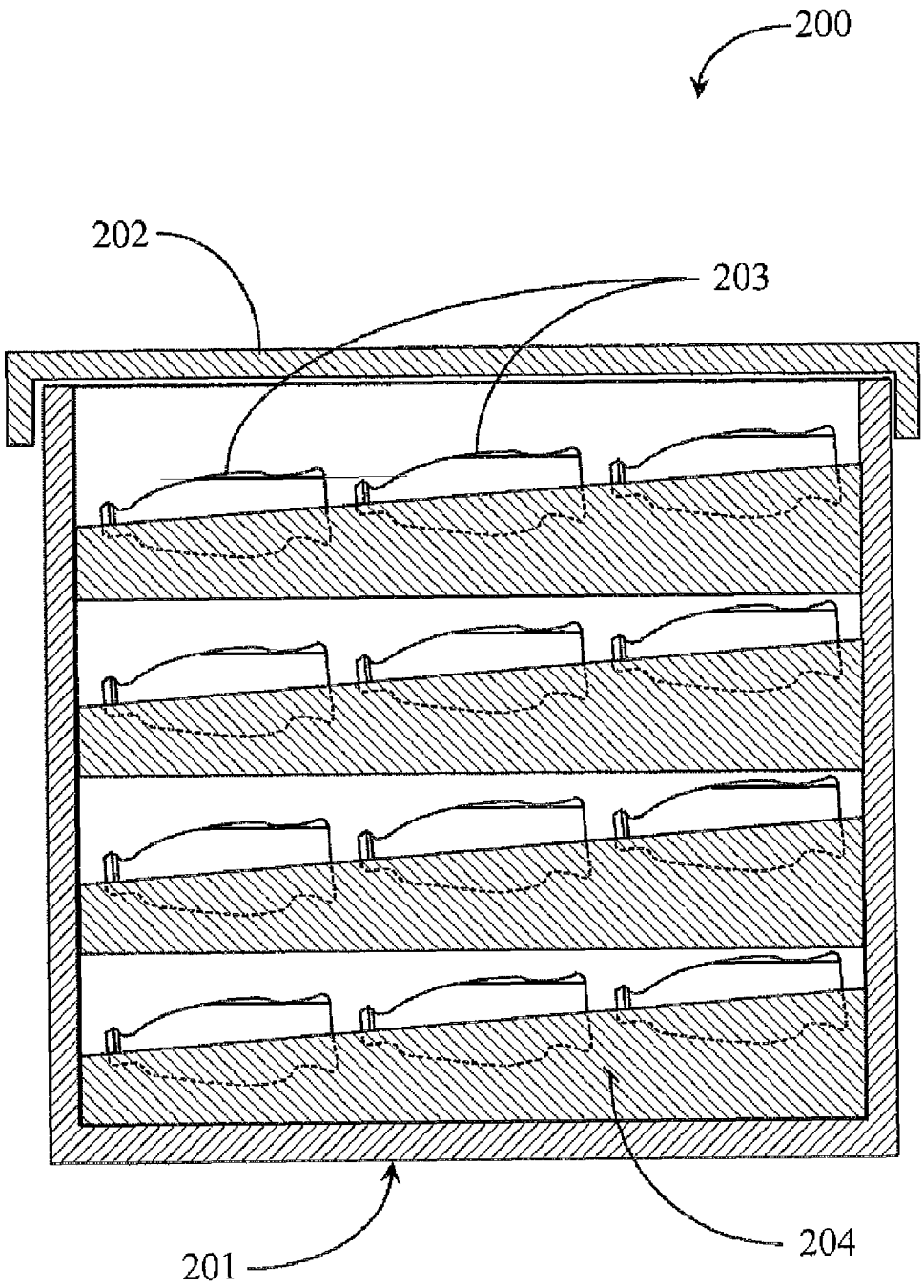
FIG. 2 is a cross-section of a shipping crate for beverage containers according to another embodiment of the present invention.

FIG. 2 is a cross-section of a shipping crate 200 for beverage containers according to another embodiment of the present invention. A crate 200 is provided for storing and transporting beverage containers (bottles) of carbonated or aerated liquids to reduce or eliminate the chance of gasses escaping the individual containers, including leakage under adverse conditions, such as long, bumpy transportation routes, hot humid weather, and long storage periods resulting in loss of evanescence or "fizz".

Crate 200 is rectangular in this example having four sides and a bottom. Crate 200 may be manufactured using plastic, wood, or any other lightweight and durable material. In one embodiment, crate 200 has a lid 202 provided to secure internal contents when storing and transporting. However, lid 202 is not absolutely required in order to practice the present invention.

Crate 200, shown in cross-section, has a configuration different from that of crate 100 described above. In this example, crate 200 has a plurality of removable inserts 204 positioned therein and adapted to support beverage containers (bottles) 203. It is noted herein that the present invention is not limited to the transport of glass or plastic bottles, but through perhaps slight adaptation, may also apply in some embodiments to the transport of aluminum beverage containers sealed by pull tab, for example.

In one embodiment, inserts 204 may be manufactured using moldable plastic sheeting formed into a desired shape and configuration, for example, a plastic heat-formed tray. In another embodiment, inserts 204 may be molded plastic inserts or molded inserts made of polymer foam. In still another embodiment, Styrofoam may be used to manufacture inserts 204.

In one embodiment inserts 204 are removable inserts that may be placed on shelves (not illustrated) as described further above with plates 103 and 104 of crate 100. In one embodiment, inserts 204 may be hung into position on the walls of crate 200 using hooks and brackets (not illustrated). The lowermost insert within crate 200 may be placed on the bottom of the crate. The overhead profile of insert 204 is rectangular in this example to conform to the rectangular dimensions of crate 200. The overall dimensioning of the insert is slightly smaller than the inside rectangular dimensioning of crate 200 so the insert may be easily inserted into and removed from crate 200. Other geometric shapes may be observed when manufacturing enclosure 200 without departing from the spirit and scope of the present invention.

"Insert 204 in one embodiment has a trapezoidal profile in side view, having a substantially horizontal bottom surface, substantially vertical sides, and a sloping top surface. The top surface of insert 204 slopes downwardly in one direction from one end of the insert to the opposite end. The exact angle of slope in one embodiment may be any angle past horizontal to about five degrees from horizontal. The angle of slope may be more than five degrees approaching vertical without departing from the spirit and scope of the present invention. Each insert in a preferred embodiment has a pattern of depressions or pockets formed therein on the top surface conforming generally to the shape of bottle 203 to a depth of about one half or less of the major diameter, and for the full length of bottle 203."

A user may load crate 200 from the bottom up by first inserting an insert 204 in the bottom of the crate and then placing bottles 203 within the depressions formed therein with the caps facing downward in the direction of the slope of the surface. After loading the first insert, a second insert may be placed in position directly over the first and may be similarly loaded with bottles 203 until the crate is full. Removing contents of the crate is practiced in reverse order. The downward facing position of the containers places the cap below any air pockets within the container achieving the same effect as the crate of FIG. 1. In this embodiment the invention supports the bottles in such a fashion that liquid is in contact with the caps at an interface between the cap and its bottle as was described above with respect to case 100. An additional sealing opportunity exists because of the higher viscosity of liquid preventing aeration or gasses from escaping from the bottle.

Figure 3:
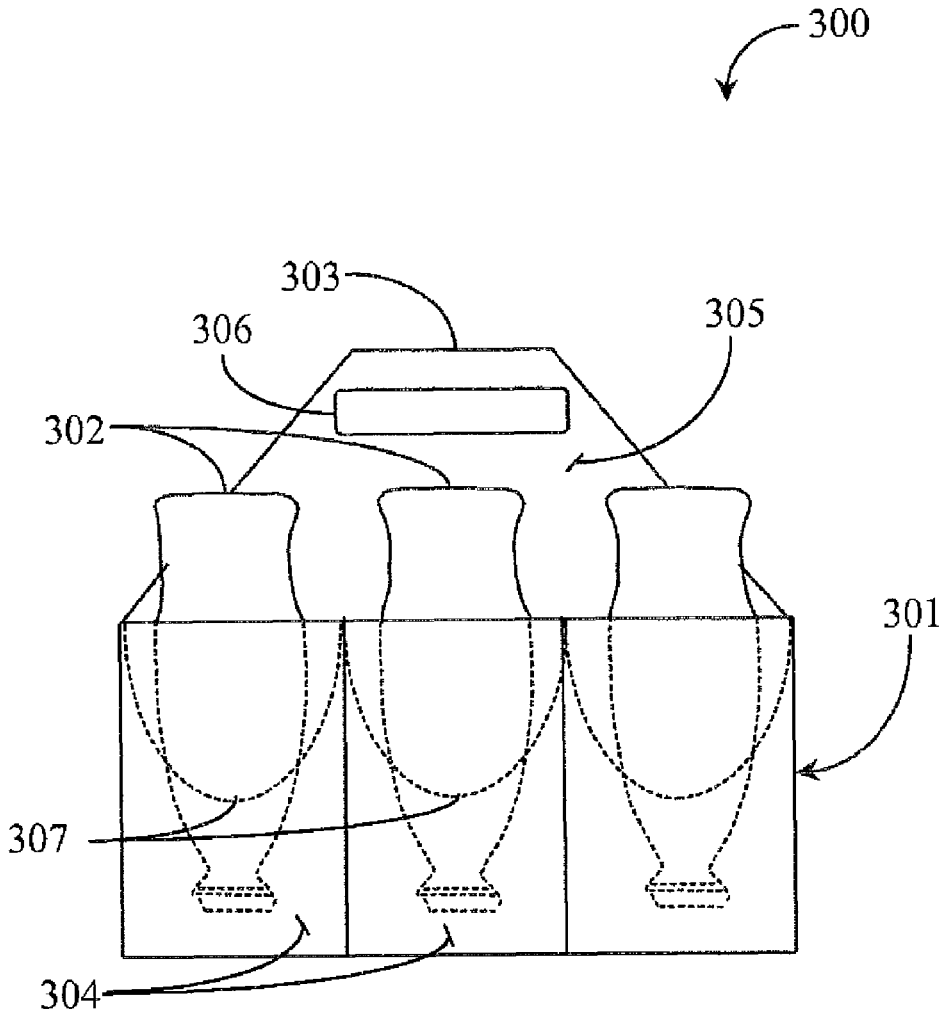
FIG. 3 is a cross-section of a storage container for beverages according to an embodiment of the present invention.

FIG. 3 is a cross-section of a storage container 300 for beverages according to another embodiment of the present invention. Container 300 is provided for moving and/or storing beverage containers (bottles or cans), illustrated herein as containers 302, in a personal setting such as at home after the point of purchase of the beverages. Container 300 may be manufactured of a resilient material 301 such as coarse paper, plastic or cardboard material. In one embodiment, container 300 may be expanded or folded out from a flat configuration or profile when used to store beverage containers. When container 300 is not supporting beverage containers, the container may be collapsed back into its original flat configuration or profile. Container 300 has a support flap 305 that extends vertically upward from a center dividing wall that functions to separate rows of rectangular beverage container compartments 304.

Container 300 in one embodiment is generally rectangular in footprint profile having a bottom and four sides. In this example, there are three adjacent compartments forming a row on each side of support flap 305 (six in total). However, there may be fewer or more compartments in each row according to desired carrying capacity. One container may hold four, six, eight, or twelve beverage containers 302, or any other number.

Each beverage container compartment includes a nesting funnel or pouch 307 formed therein for positioning and retaining individual beverage containers 302 in their respective compartments 304. Funnel 307 is adapted to conform, when expanded, to the general shape of the bottle, in this case, that the container is designed to store. Funnel 307 is formed at the major diameter to the top of each compartment 304 and extends down into each compartment to its minor diameter shaped to nest each bottle 302 around the neck portion of the bottle some distance above the cap. In this case, each bottle 302 is placed upside down into each expanded funnel formed into each compartment until all of the compartments retain a bottle.

The depth of funnel 307 is fashioned in relation to the total depth of compartment 304 so that a bottle is retained therein in a suspended fashion wherein the cap does not come into contact with the bottom of container 300. When there are no bottles in container 300, it may be folded flat for storage or easy recycling. Positioning the bottles 302 into container 300 upside down achieves the object of the present invention, causing the liquid contained in the bottles to come between the cap and the gasses trapped in the bottle. The present invention in the embodiments described herein may be adapted to enable transportation and storage of carbonated beverages such as soda, cola, effervescent waters, aerated wines, liquors, and other liquids contained in bottles or other containers wherein the gasses used to aerate or carbonate the liquids are prevented from escaping the seals used. The methods and apparatus of the present invention may also be adapted to other vessels that might be used to contain carbonated or aerated liquids such as aluminum cans, or other sealable pouches.

In this embodiment, the invention supports the bottles in such a fashion that the liquid is in contact with the caps as was described above with respect to case 100. An additional sealing opportunity exists because of the higher viscosity of liquid preventing aeration or carbonate gasses from escaping from the bottle.

Figure 4:
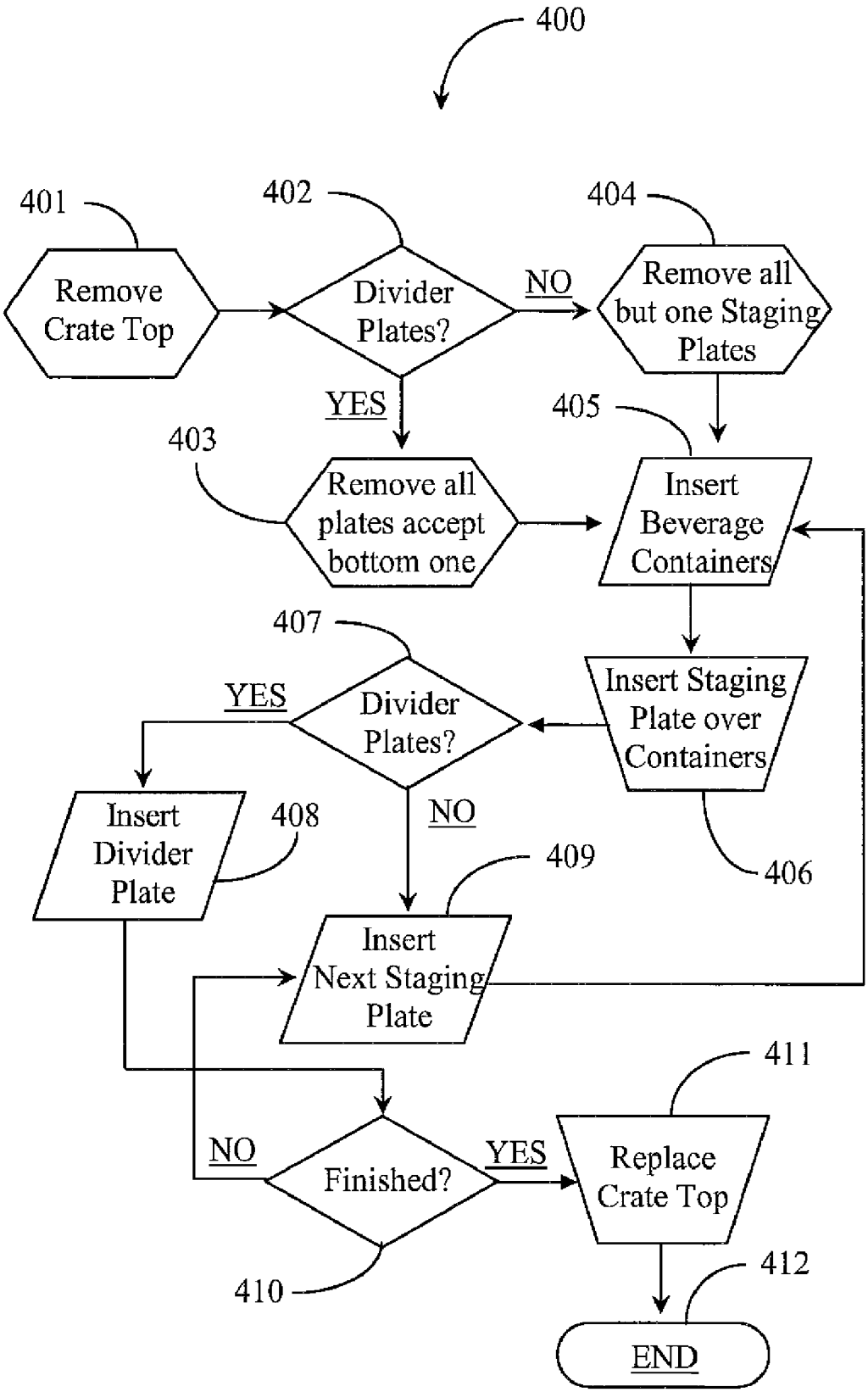
FIG. 4 is a process flow chart illustrating steps for packing a shipping crate according to one embodiment of the invention.

FIG. 4 is a process flow chart illustrating steps 400 for packing a crate with containers according to the embodiment of FIG. 1. At step 401 a user or machinery adapted to pack crates removes the top of the crate if a top is provided. At step 402 it is determined if there are divider plates for separating and closing off levels of containers. If at step 402 there are divider plates, the user removes all of the plates including the divider plates at step 403 accept for the bottommost staging plate. If at step 402 there are no divider plates provided, the user removes all but the bottommost staging plate.

It is noted herein that in the case of machine packing or crating performed in an automated environment such as in initial packaging, the crates may be staged without all of the plates inside and a top covering them and the machine may insert the appropriate plates at correct stages in an automated process and may place the tops on each crate when fully loaded with beverage containers.

At step 405 the user or machine inserts beverage containers into the cutouts of the bottom staging plate. The user or machine places or inserts the appropriate staging plate over the loaded containers at step 406. In some cases the cutouts in lower and upper staging plates for a rack are not the same for each plate. A good example is where the containers are bottles. Therefore, caution is taken to ensure that the correct plates are inserted at the appropriate stages.

At step 407 if there are divider plates for separating levels of containers, the user or machine inserts a divider plate at step 408. If at step 407 there are no divider plates then the user or machine inserts a next staging plate (lower plate) for preparing the next level of containers. Step 408 immediately precedes step 409 in the case of inserting a divider plate when the loading process is not finished. Steps 405, 406, 408 (optional), and 409 may be repeated for each level of containers stacked into a crate.

At step 410 if it is determined that the loading of containers is finished, the process moves to step 411 where the user or machine replaces or places the top on the loaded crate (if top provided). At step 412 the process may end. If at step 410 loading containers is not finished, the process loops back to step 409 and continues at step 405 repeating the steps to load a level of containers. In one embodiment it is not necessary to insert a dividing plate on the uppermost level of containers if a top is used to close the crate. If no top is used in crating, the last divider plate may serve as a top or it still may not be necessary if exposing the last level of containers is permissible. In another case a divider plate and a top cover are used.

It will be apparent to one with skill in the art of crating or packaging, that steps 400 may include more or fewer steps without departing from the spirit and scope of the invention. For example, it is possible that a rack for staging the beverage containers is provided as an assembly including the lower and upper staging plate affixed together at the proper spacing by use of spacing pillars or posts. In such a case one process step may be used to insert a rack in the enclosure before loading beverage containers eliminating one step (406) for each level of containers loaded into the enclosure.

Figure 5:
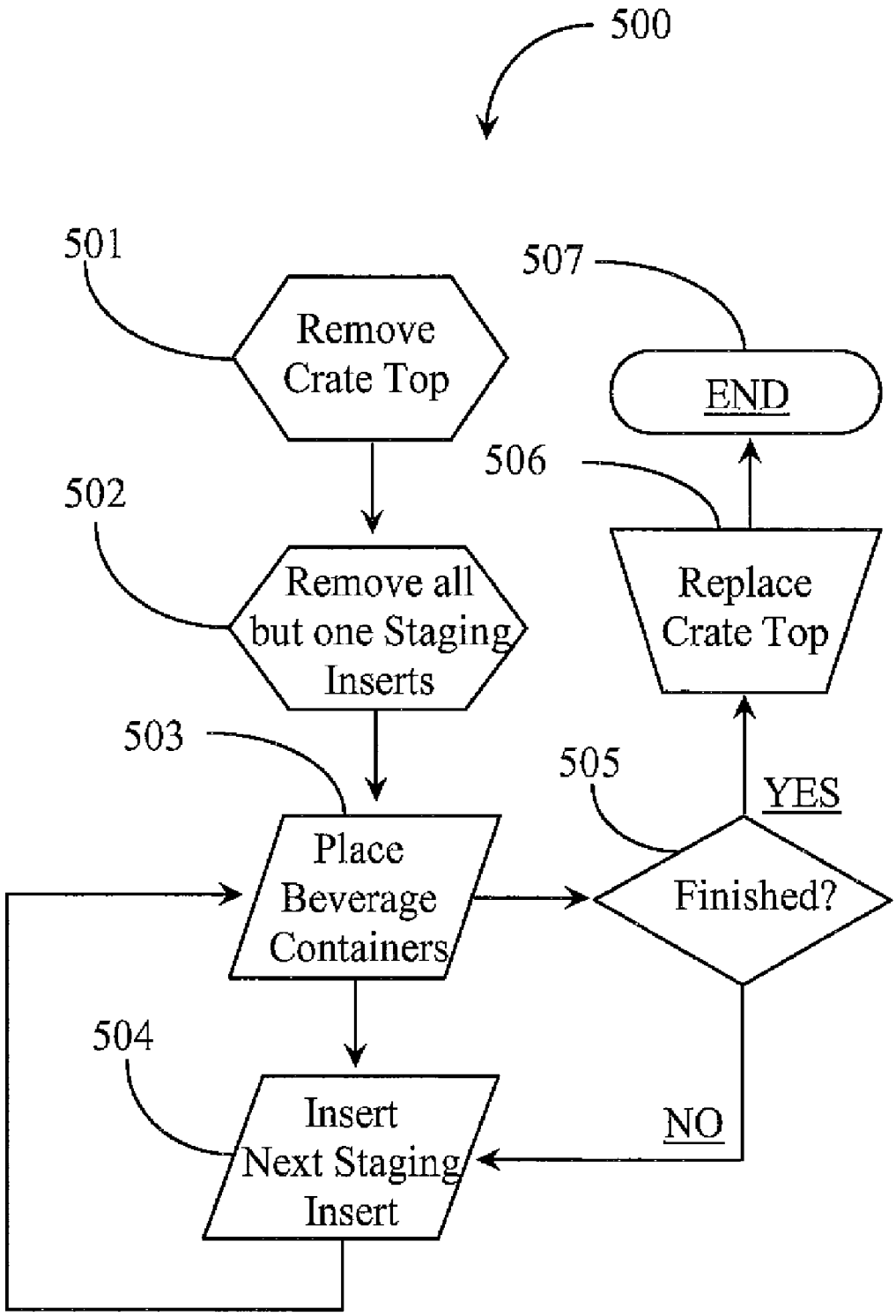
FIG. 5 is a process flow chart illustrating steps for packing a shipping crate according to another embodiment of the present invention.

FIG. 5 is a process flow chart illustrating steps 500 for packing a shipping crate according to the embodiment of FIG. 2. At step 501, a user or machine may remove the top of an empty crate. At step 502 the user or machine may remove all of the staging inserts leaving the lowermost staging insert in the bottom of the crate. In the case of a machine performing the process in an automation environment, the crate may be provided without the inserts and top at the beginning of the process without departing from the spirit and scope of the present invention.

At step 503, the user or machine places the beverage containers on the lowermost insert into the provided depressions formed in the insert. At step 504 the user or machine inserts a next staging insert on top of the one just loaded with container at step 503.

Steps 503 and 504 are repeated in succession until the crate is fully loaded. At step 505 if the process of loading the containers into the crate is complete or finished then the user or machine can replace or place the top on the crate at step 506 and the process ends for that crate at step 507. If at step 505 the process of loading the containers into the crate is not finished the process loops back to step 503 and proceeds to step 504 until finished at step 505.

It will be apparent to one with skill in the art of packaging that process steps 500 may contain fewer or more process steps without departing from the spirit and scope of the present invention. For example if divider plates are used, a step may be added into the process to accommodate placement of a divider plate over each loaded staging insert.

It will be apparent to one with skill in the art that the shipping container apparatus (crates) and point of sale storage container of the invention may be provided using some or all of the mentioned features and components without departing from the spirit and scope of the present invention. It will also be apparent to the skilled artisan that the embodiments described above are exemplary of inventions that may have far greater scope than any of the singular descriptions. There may be many alterations made in the descriptions without departing from the spirit and scope of the present invention.

What is claimed is:

1. An apparatus for supporting liquid-filled containers each container having a removable closure having a closure face and contacting an interface of the container at one end to substantially close the container in a manner to attenuate escape of gas from the container at the closure and the interface, the apparatus, comprising:

a supporting framework; and at least one insert within the framework, the at least one insert engaging the framework and each insert presenting a surface sloping from the horizontal and each insert having a plurality of indentions, each indention having the shape one of the liquid-filled containers, the shape of each indention matching a portion of the shape of the associated container extending for the full length of the container, the at least one insert and the indentions are presented such that an axis of symmetry of the container when placed in one said indention is supported such that in the container closure face is disposed facing downward and liquid in the container completely overlies the removable closure and the interface, so gas in the container will not escape between the closure and the interface.

2. The apparatus of claim 1 further comprising two or more inserts positioned in the apparatus, supporting liquid-filled containers in indentions in each of the inserts.

3. The apparatus of claim 1 wherein the at least one insert is implemented from a sheet of plastic material by heat-molding over a form.

4. The apparatus of claim 1 further comprising divider panels between layers of supported liquid-filled containers.

* * * * *